United States Patent [19]

Copeland

[11] Patent Number: 4,643,380

[45] Date of Patent: Feb. 17, 1987

[54] TRASH BAG FILLING AND PACKING FORM

[75] Inventor: Dennis J. Copeland, Pasadena, Calif.

[73] Assignee: Cardioptic Inc., Pasadena, Calif.

[21] Appl. No.: 822,483

[22] Filed: Jan. 27, 1986

Related U.S. Application Data

[63] Continuation-in-part of Ser. No. 693,103, Jan. 22, 1985, abandoned.

[51] Int. Cl.[4] ..... B65B 1/04

[52] U.S. Cl. ..... 248/97; 248/150; 220/1 T; 220/404; 141/316; 141/390

[58] Field of Search ..... 248/95, 97, 98, 99, 248/100, 101, 148, 150, 152, 174, 499, 500, 505, DIG. 7; 220/4 F, 1 T, 6, 404; 141/390, 316; 53/390

[56] References Cited

U.S. PATENT DOCUMENTS

| | | | |
|---|---|---|---|
| 2,092,969 | 9/1937 | Gustafson | 220/404 |
| 3,182,804 | 5/1965 | Chades | 248/499 |
| 3,211,404 | 10/1965 | Edmiston . | |
| 3,905,406 | 9/1975 | Cruse . | |
| 3,915,329 | 10/1975 | Zaks . | |
| 3,927,786 | 12/1975 | Aboud | 220/404 |
| 3,934,803 | 1/1976 | Paulus, Jr. . | |
| 3,936,087 | 2/1976 | Alexander . | |
| 4,014,157 | 3/1977 | Pearce | 53/390 |
| 4,222,580 | 9/1980 | Krokonko . | |
| 4,254,602 | 3/1981 | Boynton . | |
| 4,320,851 | 3/1982 | Montoya . | |
| 4,349,123 | 9/1982 | Yang . | |
| 4,440,321 | 4/1984 | Campbell . | |
| 4,485,855 | 12/1984 | Dillingham . | |

FOREIGN PATENT DOCUMENTS

| | | |
|---|---|---|
| 8005407 | 4/1982 | Netherlands . |

*Primary Examiner*—J. Franklin Foss
*Assistant Examiner*—Robert A. Olson
*Attorney, Agent, or Firm*—Albert O. Cota

[57] ABSTRACT

A form having a tapered enclosure with open end, the top being larger than the bottom having handles, or handholes, on each side. The enclosure is placed into a plastic trash bag with the top lapped over the upper lip, leaving the handles exposed. A bottom pan having a strap retained across the underside is nested into the bag covered enclosure forming a structured base and the straps is attached to the handles, or holes, with integral hooks. Trash is placed inside the assembly and compressed manually against the sides of the enclosure and the base. A lid is placed on the top of the assembly for storage and transportation and the bag is removed by disconnecting the straps along with the pan, slipping the enclosure upward out of the bag. As the enclosure is tapered inversely, the compacted trash remains inside the bag sliding easily from the form.

10 Claims, 12 Drawing Figures

TRASH BAG FILLING AND PACKING FORM

CROSS-REFERENCES TO RELATED APPLICATIONS

This application is a continuation-in-part of application Ser. No. 693,103 filed 01/22/85, now abandoned.

TECHNICAL FIELD

This invention relates to bag spreading and holding devices, more particularly to a form that holds a trash bag on the oustide, allowing filling and packing within the form and upon removal thereof leaving the contents compressed inside.

BACKGROUND ART

Prior art is replete with devices to hold open the end of a polyethylene trash bag and create some inside support to expand the interior providing a convenient method for receiving refuse. Prior art, known to the applicant at the present time, consists of the following patents:

| PATENT NO. | INVENTOR | ISSUE DATE |
|---|---|---|
| 3,211,404 | Edmiston et al | 12 October 1965 |
| 3,905,406 | Cruse | 16 September 1975 |
| 3,934,803 | Paulus, Jr. | 27 January 1976 |
| 3,936,087 | Alexander | 3 February 1976 |
| 4,229,365 | Battle | 10 November 1981 |

Cruse, Paulus, Jr., and Battle all teach a structural frame upon which the bag is supported. Battle incorporates a pair of ground engaging skids permitting the device to be dragged along the ground while maintaining the mouth of the bag in the open position.

Edmiston et al utilizes a plurality of elastic elements that render an equal pull upon a receptacle such as a vase or container that is connected to a flat stable structure. These elastic elements are extended between adjacent slots and pass under the base to form a cushion and anti-skid device for transporting contains that are basically unstable on their own base.

Paulus, Jr. teaches a support apparatus with a blade distending adjacent to the base, preventing tilting when positioned horizontally upon the ground.

Cruse, in U.S. Pat. No. 3,905,406, discloses a stand that is readily collapsible and adjustable for different sized paper bags. A wire band is wound around a pair of aligned notches and secured forming frictional binding action between elements facilitating collapsing for storage and transportation. A spring is also incorporated to accommodate smaller sized paper bags by angularly offsetting the structural member.

Finally, Alexander discloses a collection receptacle having a cylindrical base formed of sheet plastic with a scraper tray attached therefrom. The base is assembled by inserting clips into a series of holes forming a cylinder open at both ends or if it is not desired for disassembly, a band of adhesive is substituted for the clips. The scraper tray is bent and inserted into the cylinder and, likewise, attached with clips.

It will be noted that each reference except Edmiston relates to a structural apparatus to fill a plastic trash bag, however, they individually fail to accommodate any strength to allow compacting, as in most cases, rely upon the strength of the bag itself for support. Even Alexander utilizes a semi-rigid material for his cylinder that is pliable enough to roll overlapped for storage and in operation has no bottom, again relying upon the integrity of the bag in that area.

DISCLOSURE OF THE INVENTION

The use of plastic trash bags or liners has become evermore prevalent as a convenient receptacle for trash. One of the problems encountered with this type of bag, that of affording a structure to hold the top open, has been solved by prior art including many variations. This art utilizes brackets for support, stakes or prongs to be embedded into the ground and even scoops to assist in filling. One of the problems not yet addressed is inherent in the bag itself, wherein branches or sharp objects have a tendency to penetrate and tear the thin skin when being inserted or packed down.

Another application of the bag is its use for lining conventional trash cans, such as the metallic or thermoplastic type. This plastic liner is filled while in the can and removed for disposal. This application also has its drawbacks in that the bag often times tears when being pulled from the rigid trash can simply by its own weight, or it catches upon an irregular surface of the interior of the can. Another problem of this liner application is caused by the plastic bag being hard to extract from the parent can, due to the intimate contact between the inside surface and the bag. This difficulty is especially apparent when both the bag and trash can are virtually airtight. When the bag is full, lifting the top has a tendency to transfer the force to the bottom and sides expanding to an even tighter fit between contiguous surfaces, as it is forced outward to the sides. When the bag is lifted, a vacuum is pulled in the void between the bag and the bottom of the can, making extraction difficult and sometimes requiring the user to lift with one hand while holding the can with the other, creating an awkward situation. Using the bag as a liner for heavy debris or trash limits the usage as the bag, due to its thinness and effect created by static electricity, must be used singly, thereby limiting the capacity to the strength of the bag. Multiple bags would allow additional amplitude, however, this is impractical in light of the above. Compacting trash in a lined can is also inefficient, as the inherent taper in the can requires the refuse to be packed tighter at the bottom, while the force is applied at the top requiring successive compression throughout the entire load, which may be resilient by itself.

The need has long been felt to have a device that would overcome these difficulties, therefore, it is a primary object to place the bag on the outside of a hollow inversely tapered enclosure with a solid base covering the bag. This approach allows the enclosure to take the abuse when loading, instead of the tender thin-skinned bag, thereby eliminating completely the tendency to tear or penetrate the wall. Further, the taper of the device is reversed, therefore, when resilient debris, such as branches and leaves, are compacted, each layer is handled separately, therefore, the bottom is not required to be compressed from successive layers. Since the apparatus has structural integrity, compression may be vigorous, such as the user placing all of this weight onto the contents during loading. This may be accomplished by positioning his feet on the top surface forcing the trash down in tromping fashion. It will be seen that the fragile nature of the bag is replaced during loading by a solid rigid structure, completely eliminating the problems of tearing while compacting from the top surface. An important object of the invention allows the enclosure to be folded flat in the square embodiment and be stacked when not in use. This may be on top of each other when multiples are used, or on edge in single applications. Since most trash cans are unitary and take-up the same space when they are full as empty, this feature has great advantage over prior art, since space is usually at a premium.

Another object of the invention addresses the problem of the vacuum pulled by the bag when removed from the can. Inasmuch as the can is replaced by a hollow enclosure which is reversed in its taper, having the smallest opening on the top, the removal of the can from inside the bag no longer allows this phenomenon to take place, as there is no void at all between elements. It may also be noted that since a smooth side of the enclosure is contiguous with the bag, the tendency to catch and tear is also minimized.

Still another object of the invention allows double bagging to be accomplished with ease. Since the bags are placed over a rigid structure, no limit is placed on the number of bags that may be utilized and the difficulty of installation is not increased in successive layers.

Yet another object allows the invention, in a round embodiment, to be nested together for shipping and storage in a merchandising facility. This provides minimum space requirements in these areas similar to that of a conventional trash can.

A final object requires only one support enclosure to be required for multiple bags. In usage, a single enclosure may be used to compact the detritus, after which the form may be removed and the bag tied at the top and stored for removal. This procedure necessitates only a single enclosure with as many bags as required to accomplish the task at hand. In common practice, multiple cans are required, due to the difficulty in removal, therefore, the bags are used as liners only and may not be removed when the trash is dumped from the individual can.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figures 1, 2, 3, 4, 5, 6:
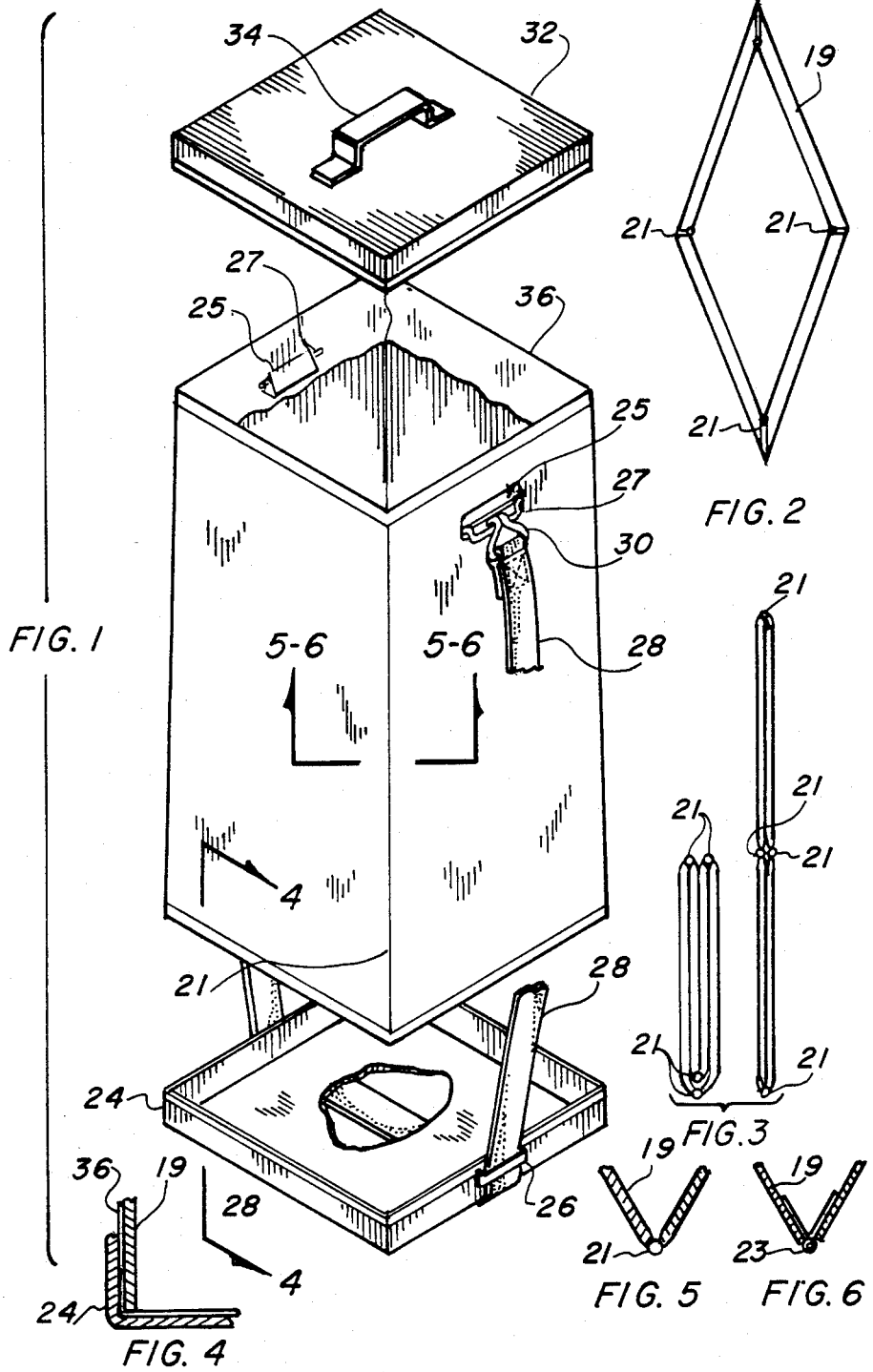
FIG. 1 is a partial exploded isometric view of the preferred embodiment with the square enclosure illustrating the sequence in which the assembly is positioned.
FIG. 2 is a plan view of the square box enclosure partially folded, as in the storage position, removed from the invention for clarity.
FIG. 3 is a plan view of the square box enclosure folded flat, in the view on the right and doubled within on the left for storage, completely removed from the invention for clarity.
FIG. 4 is a cross-sectional view taken along lines 4—4 of FIG. 1.
FIG. 5 is a partial cross-sectional view taken along lines 5—5 of FIG. 1 with an integral living hinge in the corner.
FIG. 6 is a partial cross-sectional view taken along lines 6—6 of FIG. 1 with a continuous hinge in the corner.
Figure 7:
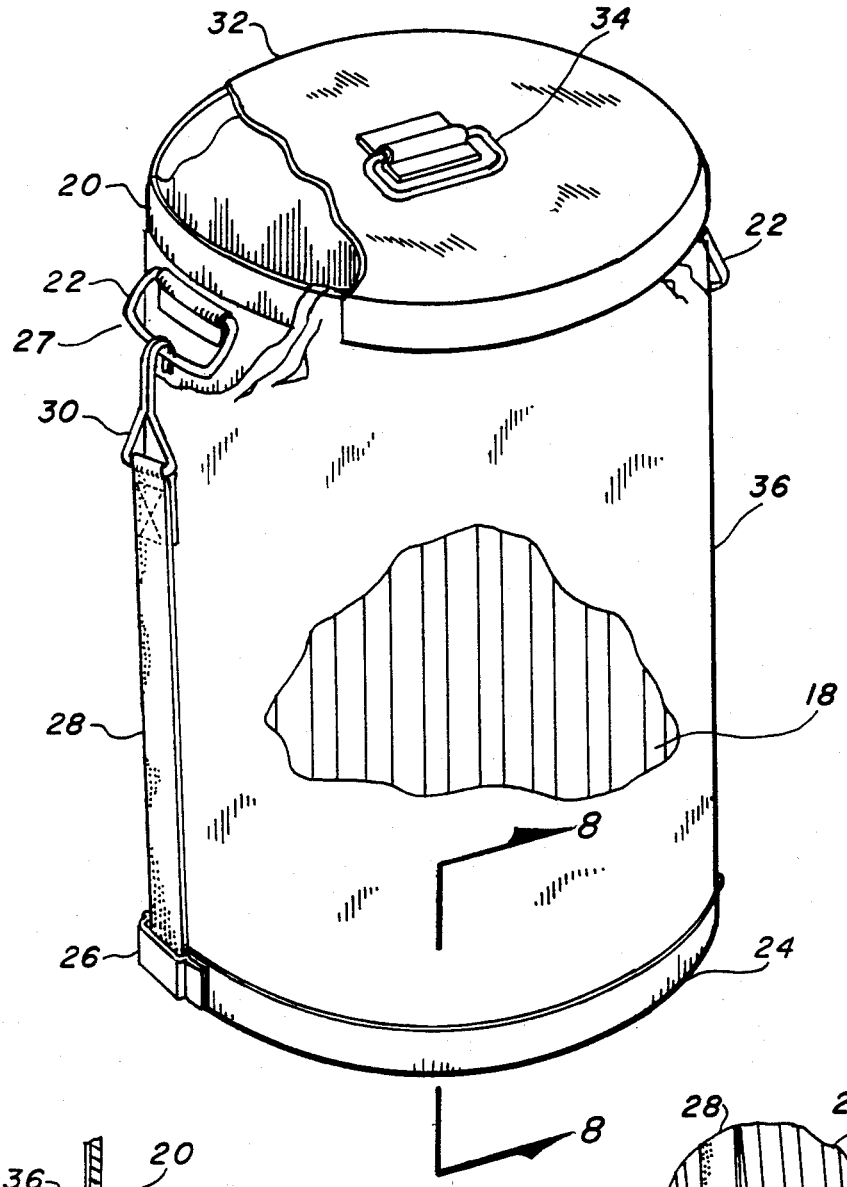
FIG. 7 is a partial isometric view of the round embodiment with the lid shown cut-away for clarity. The trash bag is installed on the cylinder with the bottom pan and lid in place.
Figure 8:
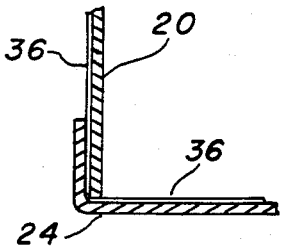
FIG. 8 is a partial cross-sectional view taken along lines 8—8 of FIG. 7.

The best mode for carrying out the invention is presented in terms of a preferred and a second embodiment. Both embodiments are primarily designed using a tapered enclosure 18 having open ends with the top of the enclosure somewhat smaller in size than the bottom. The enclosure has a smooth unrestricted surface on the outside, so as to not provide any sharp protrusions or areas that cause friction or catch a thin walled plastic bag. The preferred embodiment, best illustrated in FIGS. 1 through 6, utilizes a box 19 formed in trapezoid shape having four flat sides, two of which are attached together establishing the four corners. The material of the box 19 may be thermoplastic, such as polyethylene, polycarbonite, polypropolene, polyvinyl chloride, or the like, either vacuum formed, blown, or injection molded. Sheetmetal may also be used, such as steel or aluminum, with a protective coating suitable for the application. The four corners are attached together in a hinged manner. If thermoplastic material is used, the preferred hinge is formed integrally with the sides, as shown in FIG. 5, and is known in the art as a living hinge 21. This construction technique allows the parent material to flex in reduced thickness along the corners. If the box 19 is made of metal, or if more rigid thermoplastic is selected, a continuous hinge 23 is utilized on the corners as shown in FIG. 6. This hinge may be any type well known in the art and is attached to the box 19 by conventional methods, such as resistance welding, riveting threaded fasteners, structural adhesive, and the like.

FIGS. 2 and 3 illustrate how the box 19 is folded flat for storage purposes FIG. 2 depicts a partial folded position and the right illustration in FIG. 3 shows the box 19 completely flat. Another method of folding is depicted in the left illustration in FIG. 3 wherein the box is doubled into a condition no longer than one of the sides with only four thicknesses in width.

Gripping means 27 are utilized in the preferred embodiment in the form of a pair rotatable handles 22 that are mounted into a formed recess 25 in at least two sides of the box 19. This configuration allows the handles to be out of the way when folded flat and hinge upwardly to a fixed position away from the box 19 when lifting.

A bottom pan 24 is incorporated in the assembly and is formed with a flat underside and an upright flange sized to nest into the bottom end of the enclosure 18. This pan is completely separate and interfaces with the enclosure 18 only when in use. The method of construction and material is the same as above described for the box 19. This pan 24 rests upon the ground or floor supporting the trash inside the enclosure 18 and becomes the bottom or base of the assembly.

Figure 9:
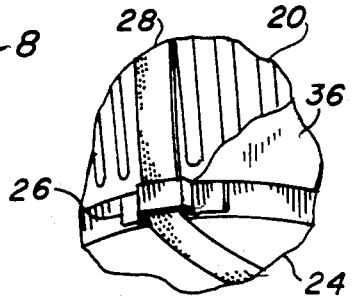
FIG. 9 is a fragmentary isometric view of the bottom portion of the invention illustrating the embodiment rotated approximately 45 degrees, illustrating the strap retainer attached to the bottom pan.

A pair of strap retainers 26 are attached onto the pan 24 at the upright flange on the opposite outside surface. These retainers 26 are in "U" shape or may be flanged into a hat section, as depicted in FIGS. 1 and 9, and are constructed of metallic bar stock or may be molded into the sides in the thermoplastic embodiment. These opposed retainers 26 serve as guides for holding attachments captive within.

A laterally flexible strap 28 with attachment means on each end is threaded into the above described strap retainers 26 and across the bottom of the pan 24 with an equal length extending from each end. Each end of the strap 28 has a hook 30 attached thereon This hook 30 is formed from a round rod formed into a shape having a loop for engaging the strap 28 on one end and bent into "J" shape on the other. The strap 28 is made of any material that is laterably flexible with a synthetic fiber, such as cotton or nylon with rayon being preferred. Attachment of the hook 30 to the strap 28 is accomplished by means well known in the art, such as stitching with thread, welding the plastic material together with heat or riveting, and the like.

Figure 10:
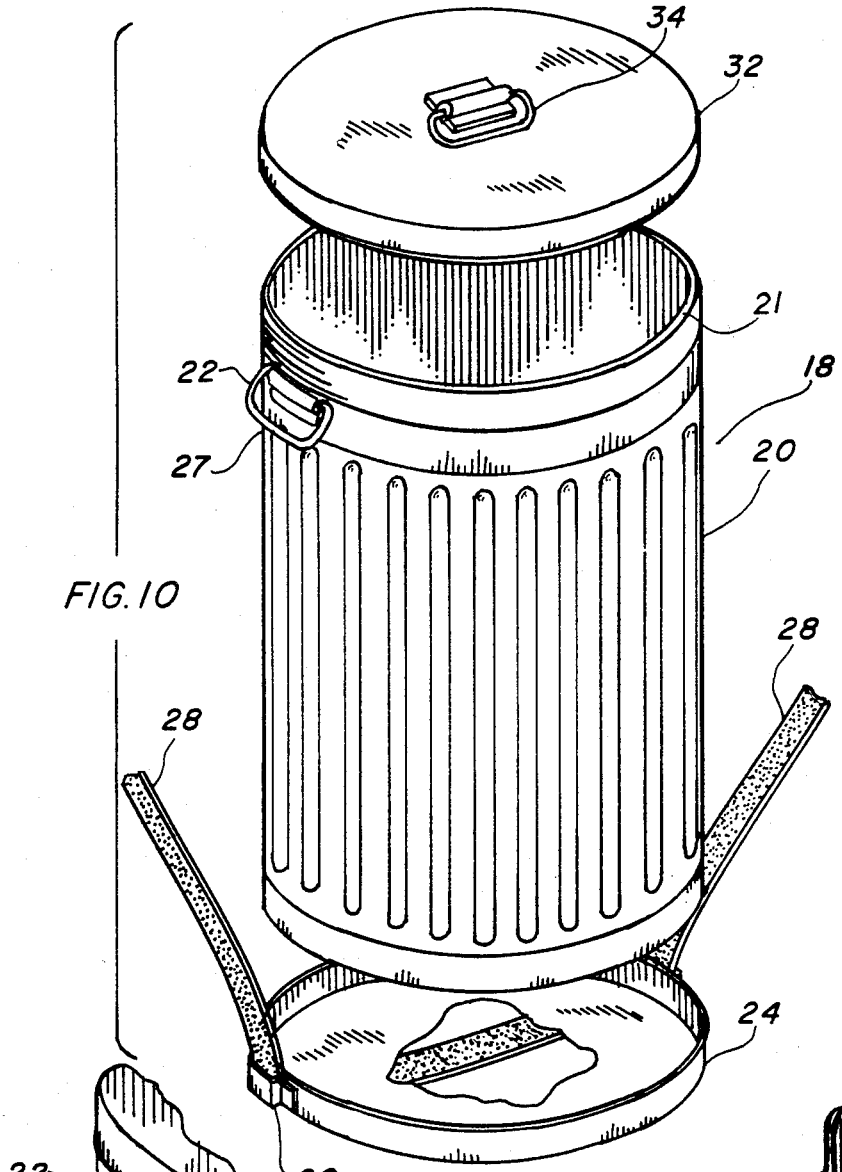
FIG. 10 is an exploded isometric view of the round embodiment with the trash bag removed completely from the assembly for clarity.
Figure 11:
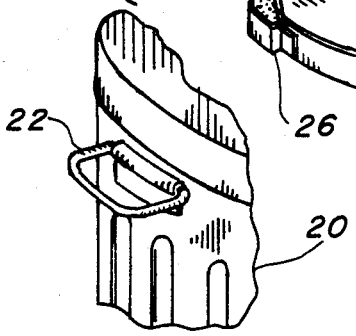
FIG. 11 is a partial fragmentary view of the cylinder handle in its uppermost position for lifting.
Figure 12:
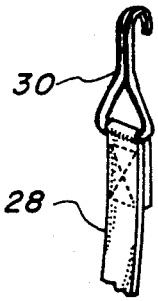
FIG. 12 is a fragmentary view of one of the ends of the strap completely removed from the invention and rotated to illustrate the attaching hook.

A lid 32 completes the assembly and is formed much like the bottom pan 24 with a flat or domed top and vertical side flanges. The inside dimensions of the lid 32 are slightly larger than the top of the enclosure 18 allowing a nesting fit when placed over the upper edge. The lid 32 further contains a handle 34 that is either fixed or rotatably secured upon the center of the top. When utilizing the hinged configuration, as shown in FIG. 1, the handle 34 lays flat upon the top when not in use and is rotated vertically to provide a surface for grasping. The fixed configuration is shown in FIG. 10.

The second embodiment is illustrated pictorially in FIGS. 7 through 12 and differs only in the shape of the enclosure and the type of handles. The shape, instead of being square, is round forming a cylinder 20 with the top diameter smaller than the bottom. This cylinder 20 may be of any material having structural integrity for the purpose, such as sheetmetal, either hot rolled or cold rolled, with a finish of a sacrificial metal electrodeposited on the top, with hot dipped galvanized being preferred. Aluminum may also be utilized for this purpose, or a thermoplastic material is suitable, either vacuum formed or injection molded. In any case, a bead 21 is either rolled or formed into the edge of the open top and bottom to stiffen and maintain the round configuration. Further, this bead 21 provides a smooth contoured end, allowing a bag to be pulled over easily without tearing or abrading. A series of raised portions longitudinally formed into the parent material may be also utilized to strengthen the walls and provide integrity of the structure. This ribbed shape is not essential to the invention, however, it allows thinner walled material to be employed.

A pair of handles 22 are rotatably affixed to the cylinder 20 on opposite sides near the top of the outside surface. This addition allows the device to be lifted easily by grasping each handle simultaneously in a conventional manner. Each handle 22 consists of a closed loop of metallic rod retained within a bracket in such a manner as to hinge upwardly to a fixed position anywhere from 90 degrees to 30 degrees from the side wall. This arrangement eliminates pinching of ones fingers when lifting the invention after it has been packed with refuse. Any practical method may be utilized to include this element as it is well known in the art.

In use the box 19 or cylinder 20 is inverted and a plastic trash bag 36, such as in common usage, is placed over the enclosure and the combination is then rotated with the smaller inside end on the top. Another method is to lift the enclosure 18 up and place it into an open bag 36. In any event the bag is on the outside surface of the enclosure 18 and completely surrounds it around the sides and across the bottom. The assembly is then placed over the bottom pan 24 nesting thereinto or may have the pan 24 so installed while in the reversed upside down position immediately after sliding the bag 36 in place. It will be noted that in this condition the bag 36 is on the outside of the enclosure 18 and on the inside the bottom pan 24, with the top lapped over the upper edge of the enclosure. In the second embodiment the bag 36 is then moved away from the handles 22 on each side, exposing them clearly without allowing the bag to slip down from the cylinder top. The strap 28 is then attached to the handles 22 with the hook 30 on each end. The handle 22, being exposed, is rotated slightly allowing the hook 30 to engage securely on one end with some force necessary on the other end to cinch the bottom pan 24 rigidly to the assembly. With the bottom pan 24 in place, the form may now be filled and manually compressed, as only the bottom surface of the bag 36 is now contiguous with the refuse and it is reinforced underneath with the structural pan. When the assembly is lifted, the handles 22 are rotated outwardly pulling directly upon the bottom pan 24. As the straps 28 deflect only slightly in the longitudinal direction the entire weight is supported entirely by the straps 28 as they continue under the pan 24. This arrangement allows the material in the pan 24 to be of a minimal thickness and transmits the lifting load from the structure to the straps 28 and assures a tight fit between the pan 24 and the box 19 or cylinder 20.

For convenience in storage, the lid 32 is positioned on the top of the assembly and fits tightly over the top of the bag 36 with the exception of the areas immediately surrounding the handles 22 in the second embodiment.

In both embodiments the contents may be stored and even moved from one place to another, as with conventional lined trash cans. To withdraw the enclosure 18 from the bag 36 leaving the contents inside, the top lid 32 is removed and the bottom pan 24 is disconnected from the gripping means 27 by detaching the straps 28. The form is then extracted upward away from the pan 24 leaving the bag 36 completely exposed, except for the enclosure 18 inside, which is then slid upward out of the bag. Inasmuch as the taper is inverted and the largest end is at the bottom, the compacted trash easily slides out of the enclosure 18, leaving it at the bottom of the now unsupported bag 36. Since the sides are smooth and the compression has been against a rigid structure, the bag 36 retains its full integrity, as it is not damaged or torn from abuse. Many other assembly and removal methods may be used and the steps varied as to the actual application and type of refuse that is to be packaged.

While the invention has been described in complete detail and pictorially shown in the accompanying drawings, it is not to be limited to such details, since many changes and modifications may be in the invention without departing from the spirit and the scope thereof. Hence, it is described to cover any and all modifications and forms which may come within the language and scope of the appended claims.

I claim:

1. A trash bag filling and packing form comprising (a) a trash bag for captivating and retaining trash;

(b) a tapered enclosure having open ends with the top end of said enclosure smaller than the bottom end, with said trash bag positioned on the outside thereof providing an unrestricted inside surface;

(c) gripping means positioned on the side surface of said enclosure near the top for lifting the device by grasping therein simultaneously;

(d) a bottom pan having a flat underside and an upright flange sized in such a manner as to rest onto said tapered enclosure bottom end defining a removable closed base for said form;

(e) a plurality of strap retainers disposed onto said bottom pan upright flange on the outside surface thereof acting as opposed guides for holding elements captively within;

(f) a laterably flexible strap having attachment means on each end positioned in such a manner as to contiguously rest upon the flat underside surface of said bottom pan and captively pass through said strap retainers connecting, with said fastening means, said gripping means on each side restraining the bottom pan onto said enclosure while having said trash bag intimately embracing the outside surface of said enclosure covering the bottom open end while overlapping into said open top end being disposed between the enclosure and the bottom pan, allowing trash to be compacted into said enclosure and removed by detaching said straps and sliding said enclosure upwardly exposing the filled trash bag.

2. The invention as recited in claim 1 wherein said enclosure further comprises a box formed in trapezoid shape having four flat sides, two of which are attached together establishing four corners.

3. The invention as recited in claim 2 wherein said box further comprises an integral living hinge connecting all four corners together allowing the box to fold flat.

4. The invention as recited in claim 2 wherein said box further comprises a continuous hinge connecting all four corners together allowing the box to fold flat.

5. The invention as recited in claim 1 wherein said enclosure further comprises a cylinder with a bead on the open top and bottom around the periphery to stiffen the structure and maintain annular configuration, and a plurality of raised portions longitudinally formed into the parent material of said cylinder to strengthen the walls thereof.

6. The invention as recited in claim 1 wherein said gripping means further comprise a pair of rotatable handles mounted into formed recesses in at least two sides of said tapered enclosure in such a manner as to hinge upwardly to a fixed position away from the enclosure.

7. The invention as recited in claim 1 wherein said gripping means further comprise closed loop handles retained within a bracket in such a manner as to hinge upwardly to a fixed position away from the enclosure.

8. The invention as recited in claim 1 wherein said strap attaching means further comprises a pair of hooks one on each end of said strap formed from a round rod bent into a shape having a loop for engaging said strap on one end and a "J" shaped hook on the other, configured in such a manner as to loopingly engage the inner surface of said gripping means.

9. The invention as recited in claim 1 further comprising a lid having vertical flanges slightly larger on the inside than said enclosure top allowing a nesting fit therebetween when placed on the top for captivating the complete interior of said packing from.

10. The invention as recited in claim 9 wherein said lid further comprises a lid handle rotatably affixed upon the top of said lid to hinge flat upon the top surface when not in use and rotate vertically to provide structure for grasping.

* * * * *